US007238093B1

(12) United States Patent
Sakamoto et al.

(10) Patent No.: US 7,238,093 B1
(45) Date of Patent: Jul. 3, 2007

(54) POLISHING CLOTH FOR CHEMICAL MECHANICAL POLISHING, AND CHEMICAL MECHANICAL POLISHING APPARATUS USING SAID CLOTH

(75) Inventors: Tatsuya Sakamoto, Kyoto (JP); Muneyuki Matsumoto, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/449,907

(22) Filed: Dec. 2, 1999

(30) Foreign Application Priority Data

Dec. 2, 1998 (JP) ..... 10-342775

(51) Int. Cl.
*B24B 29/00* (2006.01)

(52) U.S. Cl. ..... 451/287; 451/527

(58) Field of Classification Search ..... 451/285, 451/286, 287, 288, 289, 526, 527, 528, 529, 451/530
See application file for complete search history.

(56) References Cited

U.S. PATENT DOCUMENTS 5,632,790 A * 5/1997 Wiand ..... 51/298
5,778,481 A * 7/1998 Amsden et al. ..... 15/230
5,816,900 A * 10/1998 Nagahara et al. ..... 451/285

* cited by examiner

*Primary Examiner*—Timothy V. Eley
*Assistant Examiner*—Dung Van Nguyen
(74) *Attorney, Agent, or Firm*—Arent Fox LLP

(57) ABSTRACT

A chemical mechanical polishing cloth for chemically mechanically polishing a workpiece. This chemical mechanical polishing cloth includes, on the opposite-to-workpiece face thereof: polishing projections having polishing faces arranged to come in contact with a workpiece for polishing the same; polishing agent passages for introducing a polishing agent; and at least one-stage step portions formed between the polishing faces of the polishing projections and the bottoms of the polishing agent passages.

6 Claims, 8 Drawing Sheets

POLISHING CLOTH FOR CHEMICAL MECHANICAL POLISHING, AND CHEMICAL MECHANICAL POLISHING APPARATUS USING SAID CLOTH

BACKGROUND OF THE INVENTION

1. Field of the Invention

The present invention relates to a polishing cloth to be used for chemical mechanical polishing, and a chemical mechanical polishing apparatus provided with said polishing cloth.

2. Description of Related Art

In a semiconductor device production process, there are instances where a CMP (chemical mechanical polishing) processing is conducted for flattening the wafer surface.

FIG. 6 illustrates the schematic arrangement of a CMP processing apparatus of first prior art. The CMP processing apparatus comprises: a wafer head 1 which is arranged to be rotationally driven around the axis of rotation along the perpendicular direction, while suctioning and holding a wafer W with its bottom up; a polishing board 2 disposed opposite to the wafer W; and a nozzle 3 for supplying a polishing agent to the polishing board 2. The polishing board 2 comprises (i) a surface plate or platen 5 substantially in the form of a circle, in a plan elevation, of which diameter is greater than that of the wafer W, and (ii) a polishing cloth 4 fixed to the top of this platen 5. The polishing board 2 is arranged to be swung as if a circular locus is drawn along a horizontal plane.

According to the arrangement above-mentioned, the wafer W main face (which is opposite to the polishing board 2) can be polished in the following manner. That is, a load is downwardly applied to the wafer head 1 to push the wafer W against the polishing cloth 4, the wafer head 1 is rotationally driven, the polishing board 2 is swingingly driven and the polishing agent is supplied to the top of the polishing cloth 4 from the nozzle 3.

The polishing agent is composed of a slurry containing, in the form of a mixture, polishing particles such as alumina for physical polishing, and a chemical solution for chemical polishing. The polishing cloth 4 is made of foamed polyurethane for example, and is provided in the surface thereof with a number of grooves 6 in a grid pattern. Provision is made such that the polishing agent is introduced through these grooves 6 to the whole area of the polishing cloth 4.

FIG. 7 is a perspective view illustrating the arrangement of a polishing board 2A used in a second prior art. This polishing board 2A comprises a platen 5 and a polishing cloth 7 fixed to the top thereof. The polishing cloth 7 has a circular flat plate portion 7A and a number of column-like projections 7B projecting from the surface of flat plate portion 7A. In FIG. 7, the column-like projections 7B are illustrated in an exaggerated manner. In fact, the fine column-like projections 7B are arranged with high density to obtain a good polishing rate.

Alumina particles are dispersed and embedded in the column-like projections 7B. Accordingly, a physical polishing is achieved by rubbing a wafer, as coming in contact, with the tops of the column-like projections 7B. Therefore, in the second prior art, only a chemical solution for chemical polishing is supplied onto the polishing cloth 7.

FIG. 8 is a section view illustrating how the CMP processing of the second prior art in FIG. 7 is executed. The wafer W held by the underside of the wafer head 1, is pushed against the polishing cloth 7 and comes in sliding contact with the tops of the column-like projections 7B. A chemical solution 9 supplied onto the top of the polishing cloth 7 passes among the column-like projections 7B disposed with high density and is supplied to respective parts of the polishing cloth 7. However, the chemical solution 9 cannot easily enter into that portion of the polishing cloth 7 against which the wafer W is pushed by the wafer head 1. Therefore, the chemical solution 9 is supplied sufficiently in the vicinity of the edge of the wafer W, while the chemical solution 9 is insufficient in the vicinity of the center of the wafer W.

FIG. 9 is a graph showing the measurement results of polishing rates actually measure data plurality of positions of a processed wafer W. It is understood from this graph that the polishing rate is low at the center zone of the wafer W where the supply amount of the chemical solution 9 is insufficient, and that the polishing rate is high at the edge zone of the wafer W.

Likewise, in the wafer processed according to the first prior art shown in FIG. 6, the polishing rates are not uniform at the center and edge portions of the wafer.

Thus, each of the first and second prior arts is disadvantageous in that the chemical solution cannot be supplied in a satisfactory manner particularly to the wafer center, causing the polishing rates to be uneven at respective parts of the wafer.

SUMMARY OF THE INVENTION

It is an object of the present invention to provide a chemical mechanical polishing cloth capable of polishing uniformly the whole area of a workpiece to be polished.

It is another object of the present invention to provide a chemical mechanical polishing apparatus capable of polishing uniformly the whole area of a workpiece to be polished.

The chemical mechanical polishing cloth according to the present invention comprises, on the opposite-to-workpiece face thereof: polishing projections having polishing faces arranged to come in contact with a workpiece for polishing the same; polishing agent passages for introducing a polishing agent; and at least one-stage step portions formed between the polishing faces of the polishing projections and the bottoms of the polishing agent passages.

Preferably, the polishing agent passages are formed such that the polishing agent is introduced substantially uniformly substantially all the area of the opposite-to-workpiece face.

According to the present invention, the opposite-to-workpiece face is provided with the polishing projections, by which the workpiece to be polished can be polished. Further, through the polishing agent passages formed on the opposite-to-workpiece face, the polishing agent can be supplied to all the area of the opposite-to-workpiece face. At least one-stage step portions are formed between the bottoms of the polishing agent passages and the polishing faces of the polishing projections. This accelerates the flow of the polishing agent on the opposite-to-workpiece face. More specifically, even though the workpiece to be polished is being pushed against the opposite-to-workpiece face, the polishing agent can successfully be supplied to that zone of the opposite-to-workpiece face against which the workpiece to be polished is being pushed. Accordingly, the polishing agent can act uniformly throughout the workpiece to be polished, enabling the same to be polished uniformly at the whole area thereof.

Further, even though the polishing projections are disposed at high density, the polishing agent can successfully be introduced throughout the opposite-to-workpiece face. This enables a uniform polishing processing to be executed at high polishing rate.

It is preferable that the polishing cloth has a flat plate portion, that the polishing projections are formed as projecting from the flat plate portion, that the polishing agent passages are formed by grooves formed in the flat plate portion, and that the surface of the flat plate portion forms the step portions.

According to the arrangement above-mentioned, the polishing projections are formed on the flat plate portion as projecting therefrom, and the grooves are formed in the flat plate portion. This causes the surface of the flat plate portion to serve as the step portions. Thus, the step portions can relatively readily be obtained.

It is preferable that the polishing cloth has a flat plate portion, that the polishing projections are formed as projecting from the flat plate portion, and comprise a plurality of multi-stage projections having at least one-stage difference-in-level faces and the top faces serving as the polishing faces, that the polishing agent passages are formed by the spaces among the plurality of multi-stage projections, and that the difference-in-level faces form the step portions.

According to the arrangement above-mentioned, the multi-stage projections are formed on the flat plate portion. This enables the polishing projections to be formed while assuring the step portions.

In spaces among the multi-stage projections, grooves may be formed in the flat plate portion.

Each multi-stage projection may have one difference-in-level face, or two or more difference-in-level faces.

Where the height from the difference-in-level faces to the top faces in the multi-stage projections of the polishing cloth at the initial stage, is set to the wear limit assuring a uniform polishing, the polishing cloth replacing time can readily be recognized.

A chemical mechanical polishing apparatus according to the present invention comprises: a chemical mechanical polishing cloth having the arrangement above-mentioned: a polishing head for holding and rubbing a workpiece to be polished with the chemical mechanical polishing cloth; and a polishing agent supply mechanism for supplying a polishing agent to the chemical mechanical polishing cloth.

According to the apparatus having the arrangement above-mentioned, the polishing head is arranged to rub the workpiece with the chemical mechanical polishing cloth, and the polishing agent is supplied from the polishing agent supply mechanism, thus achieving a chemical mechanical polishing. At this time, the polishing agent is successfully supplied to the zone against which the workpiece is being pushed. This enables the workpiece to be uniformly polished.

Preferably, the polishing head is arranged to hold and rotate the workpiece, enabling the same to be successfully be polished.

Preferably, the polishing cloth is fixed to the platen. In such an arrangement, there is preferably disposed a platen driving mechanism for rotating the platen or swinging the platen (for example, so that a circular locus is drawn along a horizontal plane).

The polishing agent may be supplied to the polishing cloth either by a nozzle disposed opposite to the polishing cloth or through polishing agent supply passages formed in the platen. At this time, there are preferably formed, in the bottoms of the polishing agent passages of the polishing cloth, polishing agent supply openings which communicate with the polishing agent supply passages.

The polishing agent may comprise a polishing material such as alumina, and a polishing chemical solution.

Polishing particles such as alumina particles may be dispersed in the polishing projections of the polishing cloth. In such a case, it is enough to supply, to the polishing cloth, the polishing agent containing only the polishing chemical solution.

These and other features, objects and advantages of the present invention will be more fully apparent from the following detailed description set forth below when taken in conjunction with the accompanying drawings.

DESCRIPTION OF THE PREFERRED EMBODIMENTS

Figure 1:
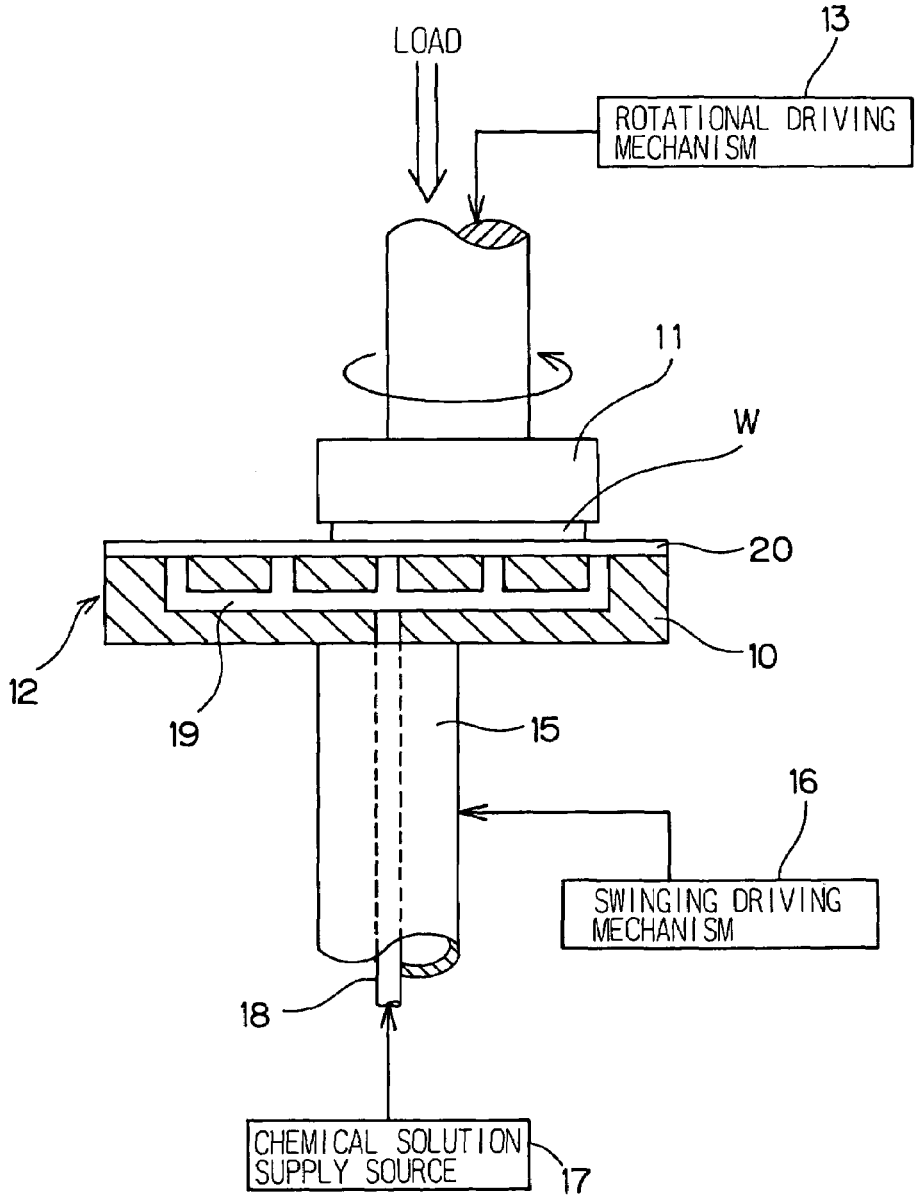
FIG. 1 is a conceptual view schematically illustrating the arrangement of a CMP processing apparatus according to a first embodiment of the present invention.

FIG. 1 is a conceptual view schematically illustrating the arrangement of a CMP processing apparatus according to a first embodiment of the present invention. This CMP processing apparatus comprises: a wafer head 11 (polishing head) for suctioning and holding a wafer W, as a workpiece to be polished, with its bottom up; and a polishing board 12 disposed opposite to the wafer head 11. The wafer head 11 is arranged to be rotationally driven around the axis of rotation along the perpendicular direction by a rotational driving mechanism 13, and also arranged to push the wafer W against the polishing board 12 by a load applying mechanism (not shown).

The polishing board 12 comprises a thick disk-like surface plate or platen 10 and a thin disk-like polishing cloth 20 fixed to the top of the platen 10. The platen 10 is supported by a hollow support 15 disposed in the perpendicular direction. This support 15 is arranged to be swung by a swinging driving mechanism 16 (platen driving mechanism). More specifically, the swinging driving mechanism 16 is arranged to swing the support 15 such that the platen 10 is swung as if a circular locus is drawn along a horizontal plane.

Inserted in the hollow support 15 is a chemical solution supply tube 18 through which there is introduced a chemical solution from a chemical solution supply source 17 having a chemical solution tank, a chemical solution supply tank or the like. The chemical solution supply tube 18 communicates with chemical solution supply passages 19 (polishing agent supply passages) formed inside of the platen 10. The chemical solution supply passages 19 communicate with a plurality of openings in the top surface of the platen 10. The chemical solution supply source 17 supplies a polishing chemical solution which forms a polishing agent. The chemical solution supply source 17, the chemical solution supply tube 18 and the chemical solution supply passages 19 form a polishing agent supply mechanism.

Figure 2:
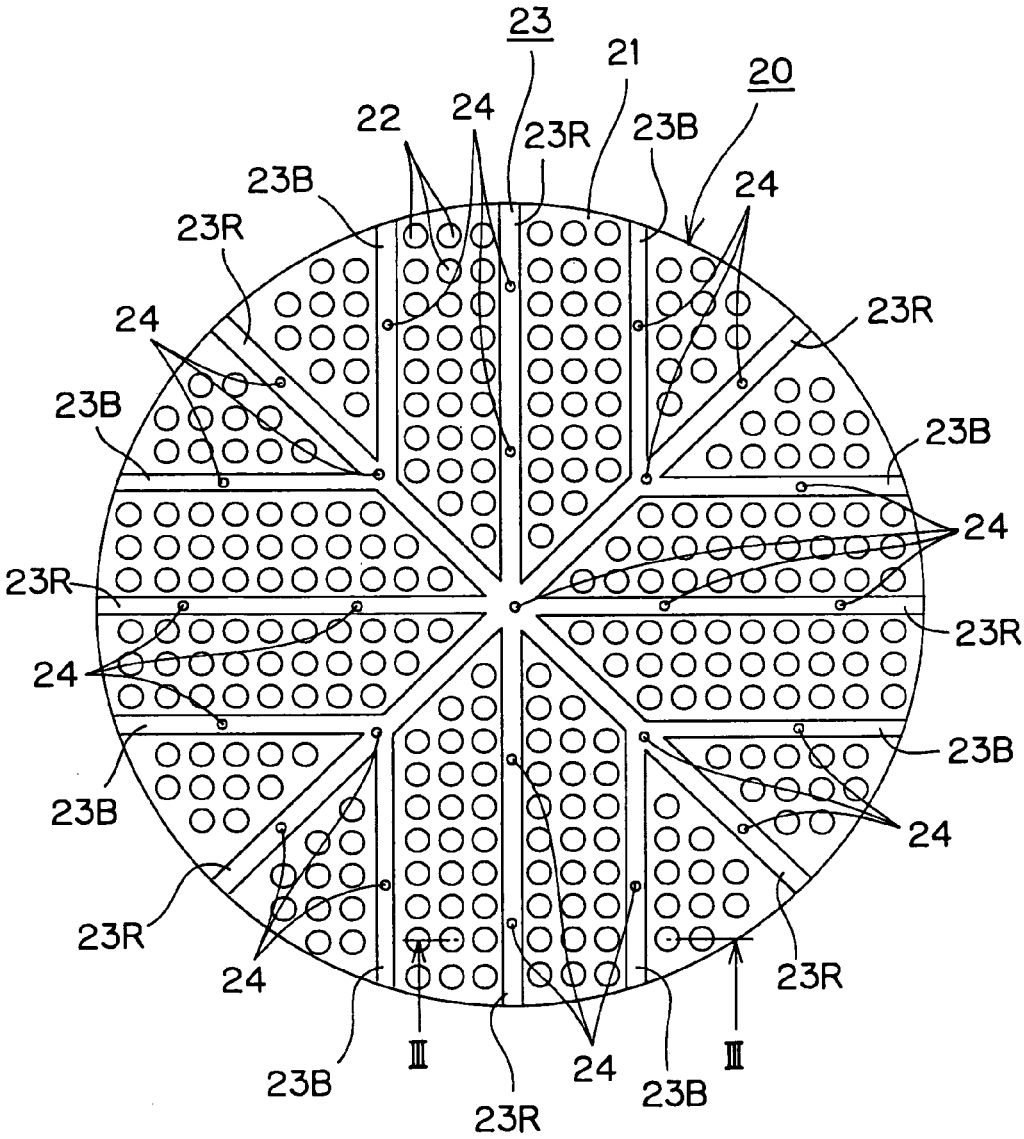
FIG. 2 is a plan view of a polishing cloth used in the CMP processing apparatus in FIG. 1.

FIG. 2 is a plan view of the polishing cloth 20. The polishing cloth 20 is made in the form of a pad of foamed polyurethane for example. This polishing cloth 20 comprises (i) a disk-like flat plate portion 21, (ii) a plurality of column-like projections 22 (polishing projections) disposed at high density as projecting from that opposite-to-workpiece face of the flat plate portion 21 which is opposite to the wafer W, and (iii) grooves 23 formed in the opposite-to-workpiece face of the flat plate portion 21.

In FIG. 2, the column-like projections 22 are illustrated in a slightly exaggerated manner. In fact, the fine projections (columns each having a diameter of about 0.2 mm) are disposed closely to one another. Alumina particles as polishing particles are dispersed and embedded in the column-like projections 22.

The grooves 23 are formed in such a pattern as to introduce the chemical solution to the whole-area of the opposite-to-workpiece face. More specifically, the grooves 23 comprise eight radial grooves 23R radially extending from the center of the flat plate portion 21 at regular or equal angular intervals, and branch grooves 23B extending from every other radial groove 23R. That is, two branch grooves 23B are branched at an angle of about 45° at both sides substantially in the vicinity of the center portion of every other radial groove 23R. A plurality of chemical solution supply openings 24 (polishing agent supply openings) are formed in the bottoms of the grooves 23. These chemical solution supply openings 24 are formed at such positions as to communicate with the chemical solution supply passages 19 through the openings formed in the top surface of the platen 10.

Figure 3:
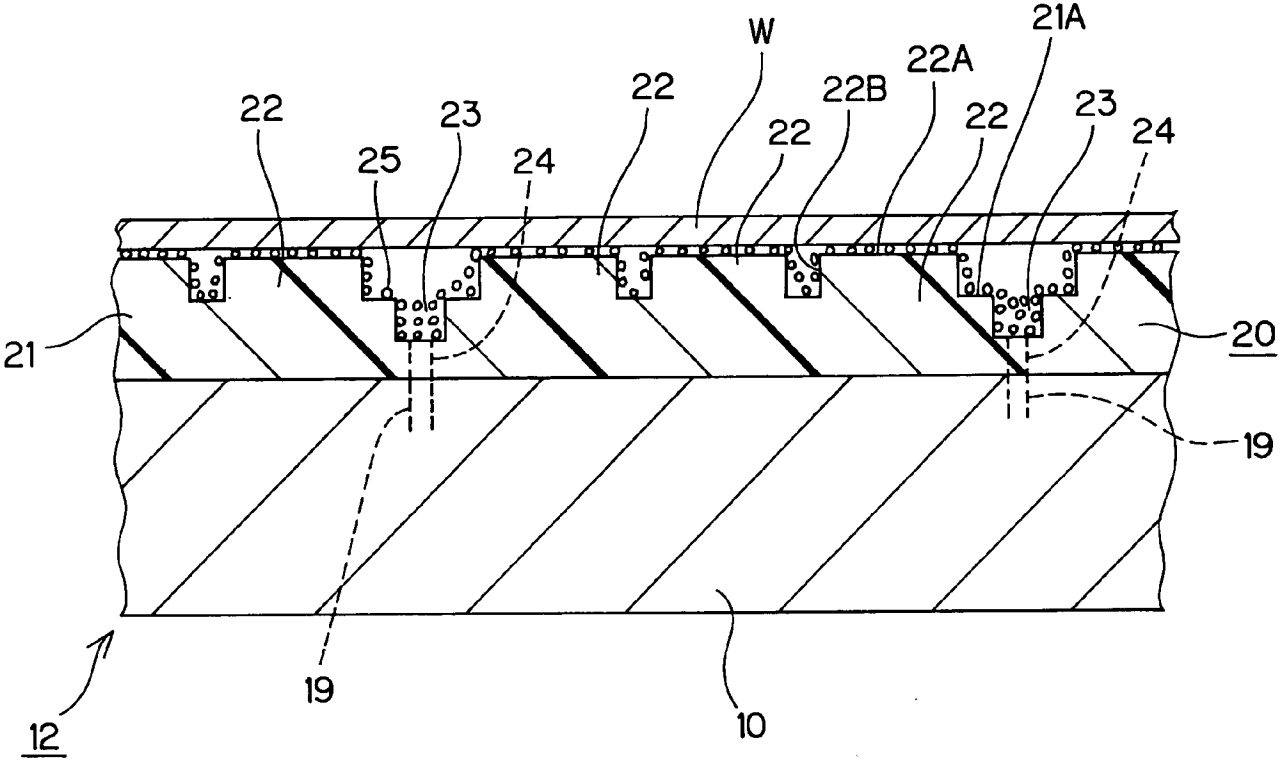
FIG. 3 is a section view taken along the line III-III in FIG. 2.

FIG. 3 is a section view, taken along the line III-III in FIG. 2, illustrating how the polishing processing is executed on the wafer W. The main face (lower face) of the wafer W is rubbed with the top faces 22A of the column-like projections 22 and is subjected to chemical mechanical polishing under the actions of both the alumina particles dispersed in the column-like projections 22 and the chemical solution supplied from the chemical solution supply passages 19 and from the chemical solution supply openings 24. The opposite-to-workpiece face of the flat plate portion 21 comprises the top faces 22A of the column-like projections 22, their lateral faces 22B, the surface 21A of the flat plate portion 21 and the inner wall faces of the grooves 23. Accordingly, the surface 21A of the flat plate portion 21 is present as a step portion between the top faces 22A serving as a wafer W polishing face, and the bottoms (bottom faces) of the grooves 23.

A chemical solution 25 (illustrated in the form of particles for better understanding) flows in the spaces among the column-like projections 22 and in the grooves 23, and is introduced to the whole area of the polishing cloth 20. As mentioned earlier, the opposite-to-workpiece face has a multi-stage arrangement having step portions between the top faces 22A of the column-like projections 22 and the bottoms of the grooves 23. This provides a good flow of the chemical solution 25 on the opposite-to-workpiece face. Accordingly, the chemical solution 25 can successfully be supplied also to that zone of the opposite-to-workpiece face which is in contact with the wafer W, particularly to the zone which is in contact with the center portion of the wafer W. This provides a uniform supply of the chemical solution 25 to the whole area of the wafer W. This enables a uniform polishing rate to be achieved for the respective parts of the wafer W, thus achieving a good polishing processing for the wafer W.

Figure 4:
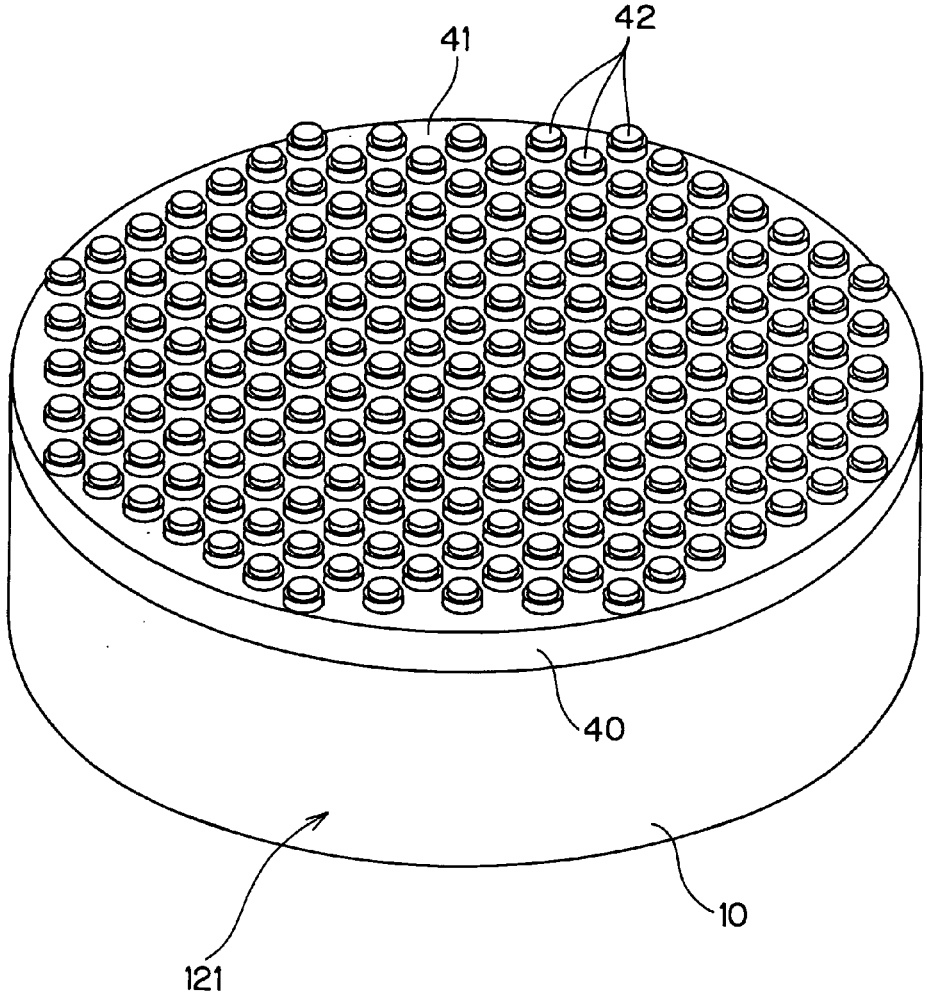
FIG. 4 is a perspective view illustrating the arrangement of a polishing board to which applied is a polishing cloth according to a second embodiment of the present invention.

FIG. 4 is a perspective view illustrating the arrangement of a polishing board 121 using a polishing cloth 40 according to a second embodiment of the present invention. This polishing board 121 is to be used instead of the polishing board 12 in FIG. 1. This polishing board 121 comprises a surface plate or platen 10 having an arrangement similar to that of the platen 10 in the first embodiment, and the polishing cloth 40 fixed to this platen 10.

The polishing cloth 40 is made in the form of a pad of foamed polyurethane or the like, and comprises a flat plate portion 41 and a plurality of multi-stage column-like projections 42 (polishing projections) projecting from the flat plate portion 41. The surface of the flat plate portion 41 and the surfaces of the projections 42 form an opposite-to-workpiece face which is opposite to a wafer serving as a workpiece to be polished. In FIG. 4, the projections 42 are shown in an exaggerated manner. In fact, the fine projections 42 are formed with high density on the flat plate portion 41.

Figure 5:
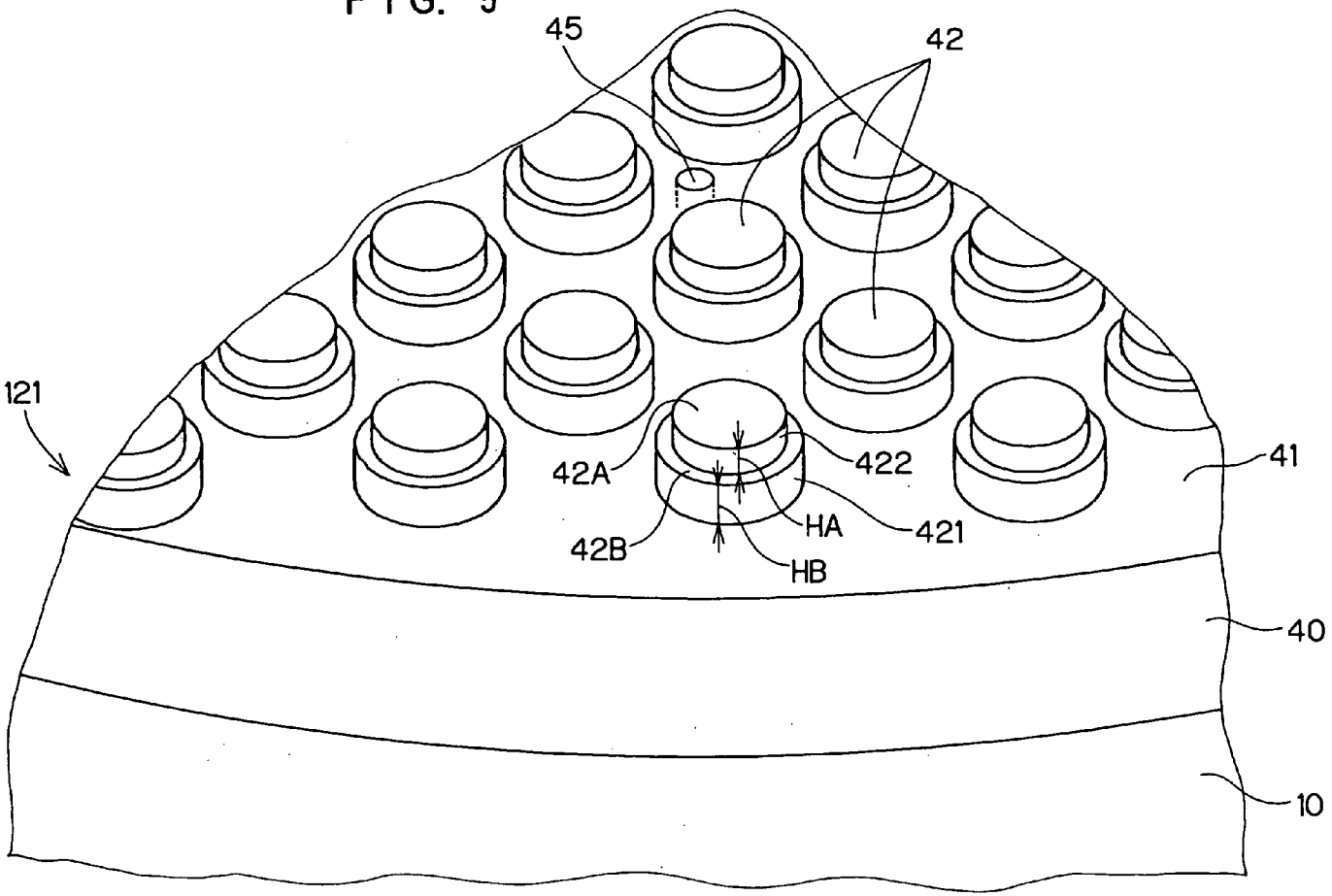
FIG. 5 is an enlarged perspective view illustrating the arrangement of projections formed on the polishing cloth of the second embodiment in FIG. 4.
Figure 6:
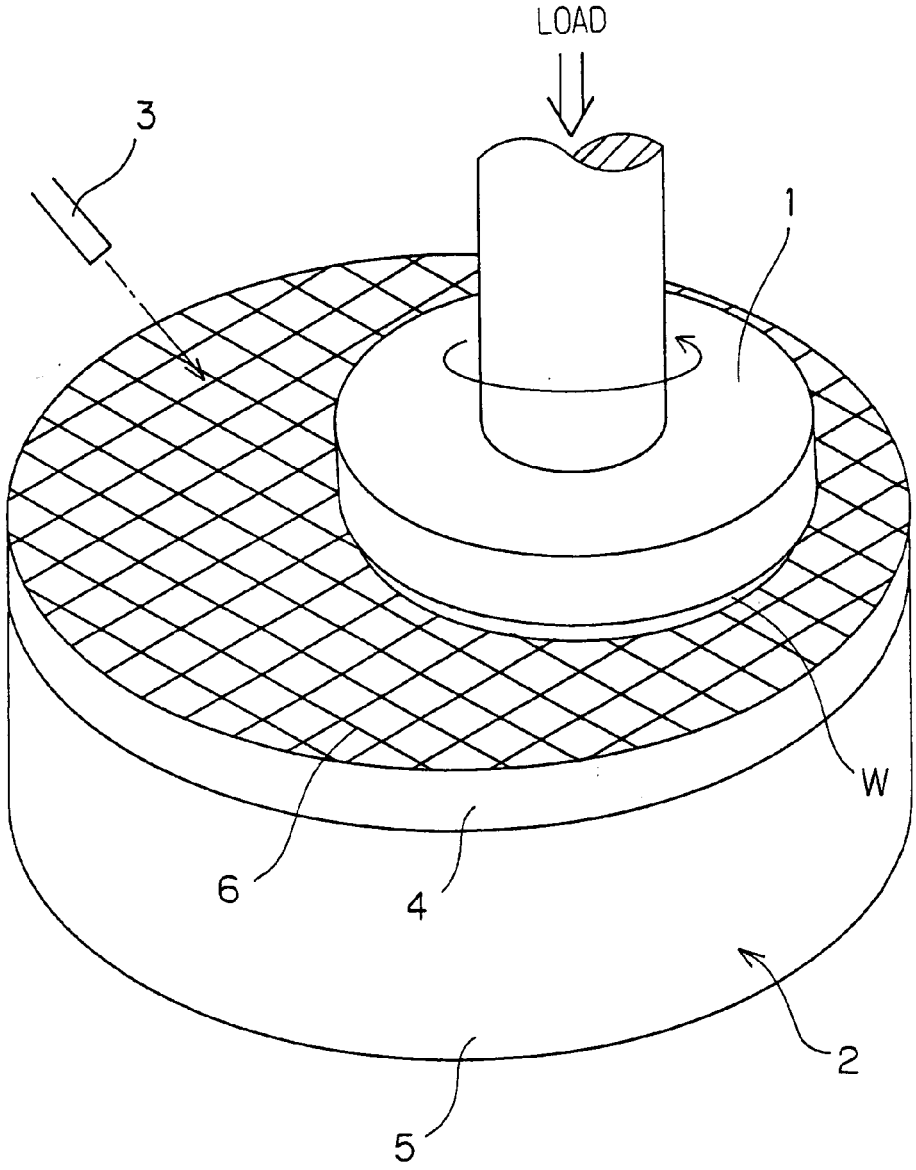
FIG. 6 PRIOR ART
FIG. 6 is a view illustrating the schematic arrangement of a CMP processing apparatus of prior art.
Figure 7:
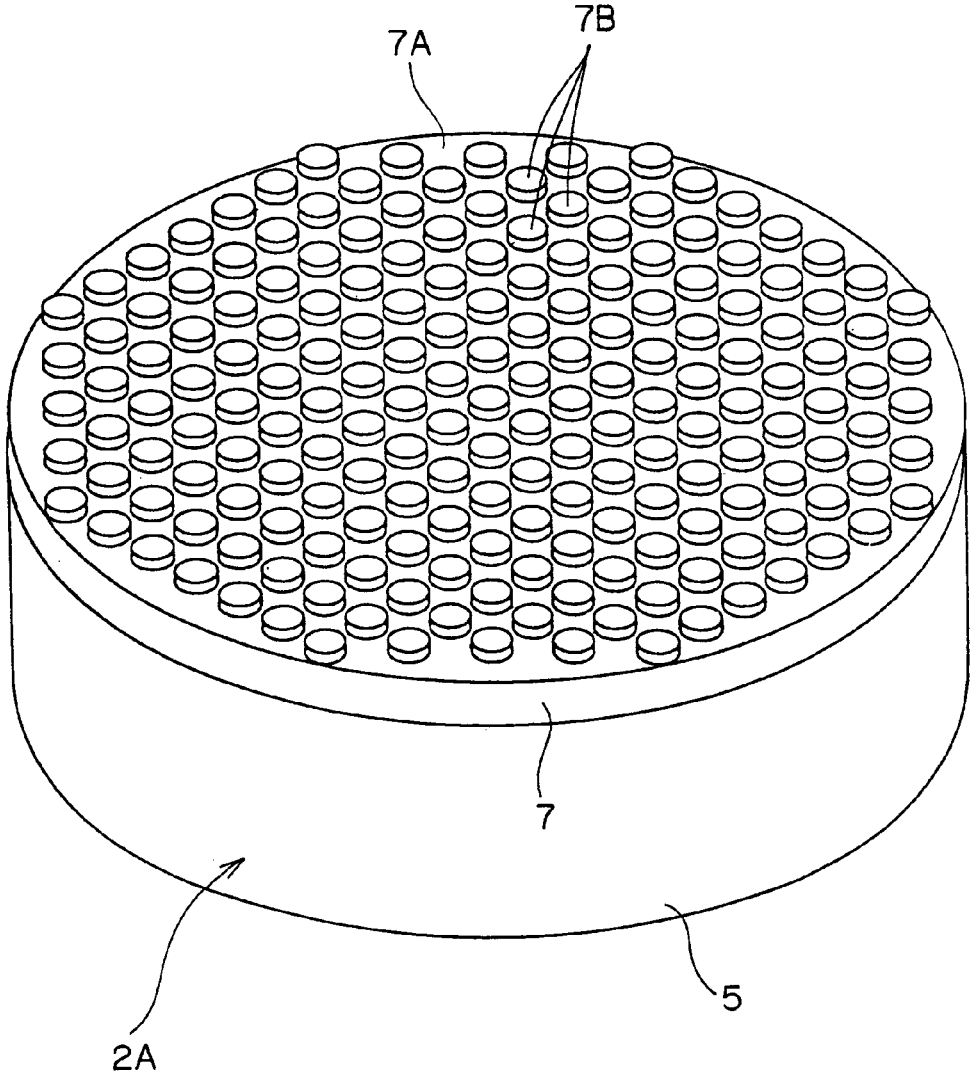
FIG. 7 PRIOR ART
FIG. 7 is a perspective view illustrating a polishing board used in another prior art.
Figure 8:
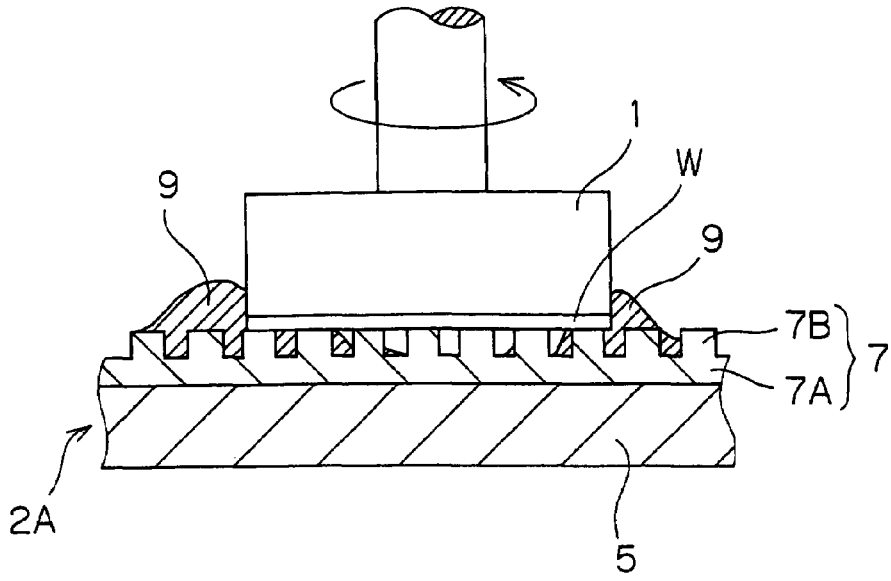
F I G. 8 PRIOR ART
FIG. 8 is a section view illustrating how a CMP processing of the second prior art in FIG. 7 is executed.
Figure 9:
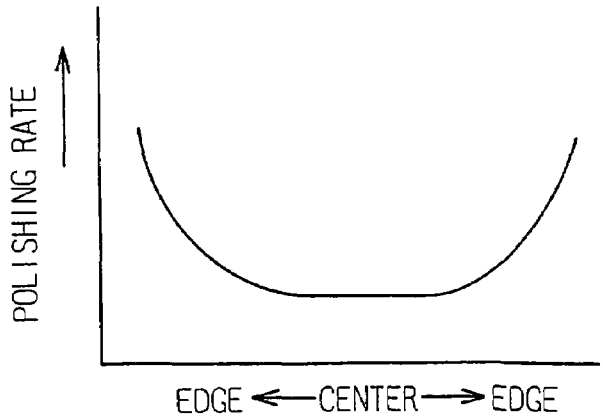
FIG. 9 is a graph showing the measurement results of polishing rates actually measured at a plurality of positions of a processed wafer.

FIG. 5 is an enlarged perspective view illustrating the arrangement of the projections 42. Each of the projections 42 has a large-diameter column portion 421 standing from the flat plate portion 41, and a small-diameter column portion 422 standing from the large-diameter column portion 421, the small-diameter column portion 422 being smaller in diameter than the large-diameter column portion 421. The top faces 42A of the small-diameter column portions 422 serve as a polishing face for polishing the wafer W, and are substantially parallel with the surface of the flat plate portion 41. At the joint part between each large-diameter column portion 421 and each small-diameter column portion 422, there is formed each difference-in-level face 42B substantially parallel with each top face 42A. Each difference-in-level face 42B forms each step portion between each top face 42A and the surface of the flat plate portion 41.

Alumina particles as polishing particles are dispersed and embedded in the projections 42. Accordingly, only the chemical solution is supplied to the polishing cloth 40. Chemical solution supply openings 45 (polishing agent supply openings)(not shown in FIG. 4) are suitably formed in the flat plate portion 41. The chemical solution supply openings 45 communicate with the chemical solution supply passages 19 (See FIG. 1) through openings formed in the top surface of the platen 10.

Provision is made such that the chemical solution supplied from the chemical solution supply openings 45 is supplied to the respective parts of the polishing cloth 40 through chemical solution passages (polishing agent passages) formed by the spaces among the projections 42. The step portions formed by the difference-in-level faces 42B are formed between the top faces 42A of the projections 42 and the surface of the flat plate portion 41. This provides a good flow of the chemical solution. More specifically, the chemical solution can successfully be introduced up to that center portion of the zone which is in contact with the wafer. Likewise in the first embodiment, the polishing rate can substantially be uniform for the whole area of the wafer, thus achieving a good polishing processing.

Preferably, the height HB of each large-diameter column portion 421 of each projection 42 from the surface of the flat plate portion 41, is not less than the height which assures the flow of the chemical solution on the opposite-to-workpiece face of the polishing cloth 40. The small-diameter column portions 422 will be worn as used for polishing workpieces to be polished such as wafers. Accordingly, each height HA of each small-diameter column portion 422 from each difference-in-level face 42B is reduced with the usage of the polishing cloth 40. It is therefore preferable that each height HA of each small-diameter column portion 422 of the polishing cloth 40 at the initial stage, is set to the height corresponding to a wear limit. Here, the wear limit refers to the limit point where the wafer polishing uniformity is not injured. In the arrangement in FIG. 5, the user can know the wear limit based on the height of the small-diameter column portions 422 from the difference-in-level faces 42B.

Thus, embodiments of the present invention have been discussed, but the present invention can also be embodied in other forms. For example, the first embodiment may be modified such that, instead of the column-like projections 22, the multi-stage column-like projections 42 in the second embodiment are used. According to this arrangement, there are formed, between the bottoms of the grooves 23 and the top faces 42A of the multi-stage column-like projections 42, two step portions comprising the difference-in-level faces 42B and the surface of the flat plate portion 21. This further accelerates the flow of the chemical solution on the surface of the polishing cloth.

In each of the first and second embodiments above-mentioned, the chemical solution is supplied through the chemical solution supply passages 19 formed in the platen 10. However, the chemical solution may be supplied by a nozzle disposed at a position opposite to the polishing board 12, 121, for example a position off to the upper left or right of the polishing board 12, 121.

In each of the first and second embodiments above-mentioned, the description has been made of the polishing cloth 20, 40 having the column-like projections 22, 42. However, there may be used pillar-like projections each of which has other section shape such as a square. Also, there may be used projections each having other optional shape than a pillar shape, e.g., a truncated-cone shape having a top face which comes in contact with a workpiece to be polished.

In the second embodiment, the description has been made of the polishing cloth 40 having the multi-stage column-like projections 42 having the one-stage difference-in-level faces 42B. However, there may be used pillar-like or other-shape projections having difference-in-level faces of two or more stages. To prevent the polishing rate from being deteriorated, however, provision should be made not to reduce so much that zone of each polishing face which comes in contact with a workpiece to be polished.

In each of the embodiments above-mentioned, the description has been made of the arrangement in which polishing particles are dispersed in the polishing cloth 20, 40 and only the polishing chemical solution is supplied thereto. However, provision may be made such that polishing particles such as alumina particles are not dispersed in the polishing cloth and that a slurry containing, in a mixture, polishing particles and a chemical solution is supplied to the surface of the polishing cloth. According to such an arrangement, the slurry may be supplied from a nozzle disposed at a position opposite to the polishing cloth, e.g., a position off to the upper left or right of the polishing cloth.

In each of the embodiments above-mentioned, the description has been made of a wafer which is taken as an example of a workpiece to be polished. However, examples of the workpiece to be chemically mechanically polished, include a disk-type recording medium such as a compact disk, a floppy disk and the like, and a display panel glass sheet such as a liquid crystal display panel, an EL (Electro Luminescence) panel and the like. The present invention may successfully be applied for polishing the workpieces above-mentioned.

In addition to the foregoing, a variety of modifications in design may be made without departing from the scope of the appended claims.

Embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This application claims priority benefits under 35 USC § 119 of Japanese Patent Application Serial No. 10-342775, filed on Dec. 2, 1998, the disclosure of which is incorporated herein by reference.

What we claim is:

1. A polishing cloth for chemically mechanically polishing a workpiece, said chemical mechanical polishing cloth comprising, on an opposite-to-workpiece face thereof:

polishing projections having polishing faces arranged to come in contact with the workpiece for polishing the same and disposed in a first plane;

polishing agent passages, having bottoms disposed in a second plane, for introducing a polishing agent; and a plurality of one-stage step portions formed between said polishing faces of said polishing projections and the bottoms of said polishing agent passages and disposed in a third plane, the first, second and third planes spaced apart from and extending parallel to one another.

2. A chemical mechanical polishing cloth according to claim 1, wherein each one of the polishing projections is columnar shaped.

3. A chemical mechanical polishing cloth according to claim 2, wherein each one of the polishing projections has a first columnar portion having a first diameter and a second columnar portion having a second diameter larger than the first diameter, the first columnar portions having flat, circular end surfaces forming the polishing faces the second columnar portion attached to the first columnar portion to define a circumferential, flat edge section surrounding the first columnar portion, the circumferential, flat edge sections forming the plurality of one-stage step portions.

4. A chemical mechanical polishing cloth for chemically mechanically polishing a workpiece, said chemical mechanical polishing cloth comprising, on an opposite-to-workpiece face thereof:

polishing projections having polishing faces arranged to come in contact with a workpiece for polishing the same;

polishing agent passages, having bottoms, for introducing a polishing agent; and at least one-stage step portions formed between said polishing faces of said polishing projections and the bottoms of said polishing agent passages, wherein:

said polishing cloth has a flat plate portion;

said polishing projections are formed as projecting from said flat plate portion;

said polishing agent passages are formed by grooves formed in said flat plate portion; and the surface of said flat plate portion forms said step portions.

5. A chemical mechanical polishing apparatus, comprising:

a chemical mechanical polishing cloth for chemically mechanically polishing a workpiece;

a polishing head for holding and rubbing a workpiece with said chemical mechanical polishing cloth; and a polishing agent supply mechanism for supplying a polishing agent to said chemical mechanical polishing cloth, said chemical mechanical polishing cloth including, on an opposite-to-workpiece face thereof:

polishing projections having polishing faces arranged to come in contact with the workpiece for polishing the same and disposed in a first plane;

polishing agent passages, having bottoms disposed in a second plane, for introducing a polishing agent; and a plurality of one-stage step portions formed between said polishing faces of said polishing projections and the bottoms of said polishing agent passages and disposed in a third plane, the first, second and third planes spaced apart from and extending parallel to one another.

6. A chemical mechanical polishing apparatus comprising:

a chemical mechanical polishing cloth for chemically mechanically polishing a workpiece;

a polishing head for holding and rubbing a workpiece with said chemical mechanical polishing cloth; and a polishing agent supply mechanism for supplying a polishing agent to said chemical mechanical polishing cloth, said mechanical polishing cloth including, on an opposite-to-workpiece face thereof:

polishing projections having polishing faces arranged to come in contact with a workpiece for polishing same;

polishing agent passages, having bottoms, for introducing a polishing agent; and at least one-stage step portions formed between said polishing faces of said polishing projections and the bottoms of said polishing agent passages, wherein said polishing cloth has a flat plate portion;

said polishing projections are formed as projecting from said flat plate portion;

said polishing agent passages are formed by grooves formed in said flat plate portion and the surface of said flat plate portion forms said step portions.

* * * * *